United States Patent [19]

Sherrod

[11] 4,106,882

[45] Aug. 15, 1978

[54] POSITIVE DISPLACEMENT PUMP FOR SEMI-FLUID MATERIALS

[76] Inventor: Eugene L. Sherrod, Via Massimo d'Azeglio 2, 20052 Monza, Italy

[21] Appl. No.: 598,991

[22] Filed: Jul. 25, 1975

[51] Int. Cl.[2] ..... F04B 7/00

[52] U.S. Cl. ..... 417/517; 417/539; 417/900

[58] Field of Search ..... 417/516-519, 417/531-532, 900; 137/610, 625.4

[56] References Cited

U.S. PATENT DOCUMENTS

| | | | |
|---|---|---|---|
| 422,770 | 3/1890 | Grasser | 137/610 |
| 3,298,322 | 1/1967 | Sherrod | 417/900 |
| 3,726,614 | 4/1973 | Schellenberg | 417/517 |
| 3,963,385 | 6/1976 | Caban | 417/900 X |

*Primary Examiner*—Carlton R. Croyle
*Assistant Examiner*—Edward Look
*Attorney, Agent, or Firm*—Ira Milton Jones & Associates

[57] ABSTRACT

A positive displacement pump for forcing semi-fluid materials and especially concrete into a delivery pipe for transmission to a remote location, comprising a pair of parallel pump cylinders having mouths opening to a feed chamber in which a swivel valve having an S-shaped lengthwise extending material conducting passage is mounted for oscillation about a fixed axis that is equispaced from and parallel with the axes of the pump cylinders, alternately between two defined positions in each of which the mouth of one of the pump cylinders is uncovered to enable material in the feed chamber to be inducted into that cylinder by retraction of its piston and the other cylinder is communicated with the delivery pipe by means of the material conducting passage of the valve, the pump being characterized by the fact that the loads imposed on the swivel valve by the force of the discharging pump cylinder are transmitted to and carried by the bottom wall of the feed chamber by virtue of the fact that the bottom outer surface of the valve, for the major portion of its axial dimension, is a segment of a frustum of a cone and the inner surface of the feed chamber bottom is shaped to have an area thereof closely contiguous to that conical bottom surface of the valve in all positions of the valve.

17 Claims, 11 Drawing Figures

20
34'
34
31
42
33
13
27
17
19
24
40
25
14
43'
45
43
4
4
30
32
11
12
18
15
3
3
31'
31
31'

Fig. 3
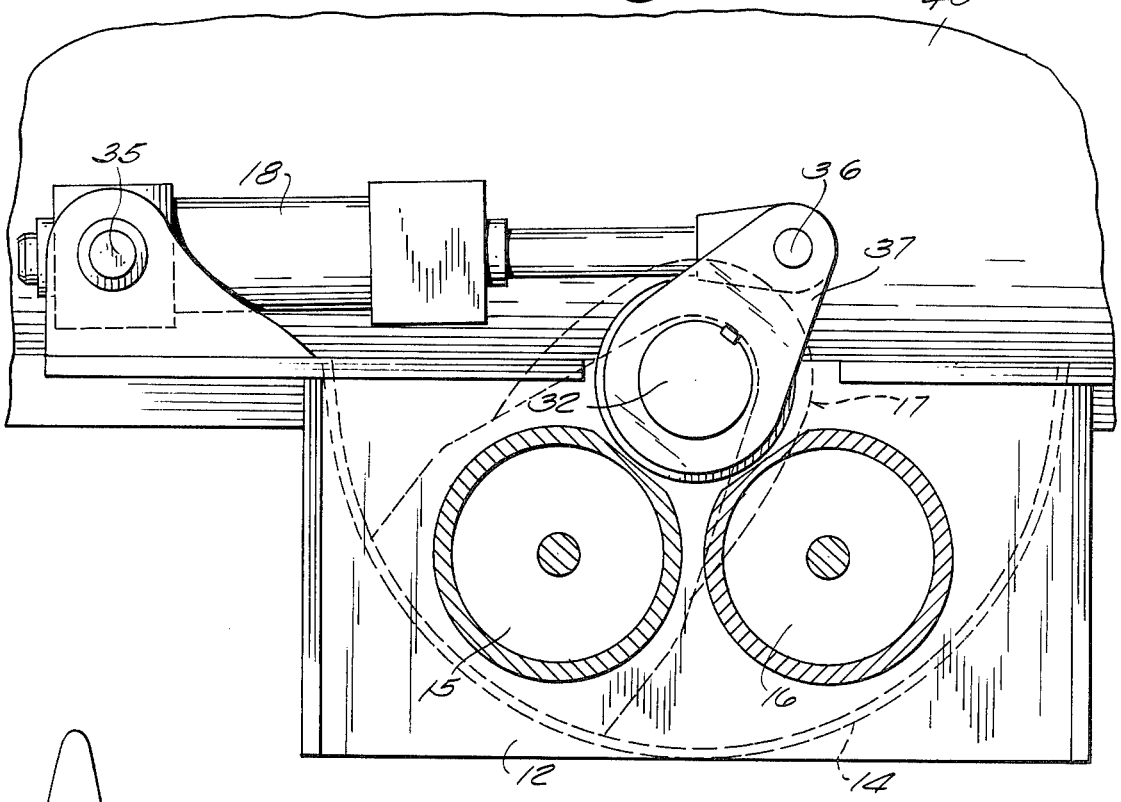
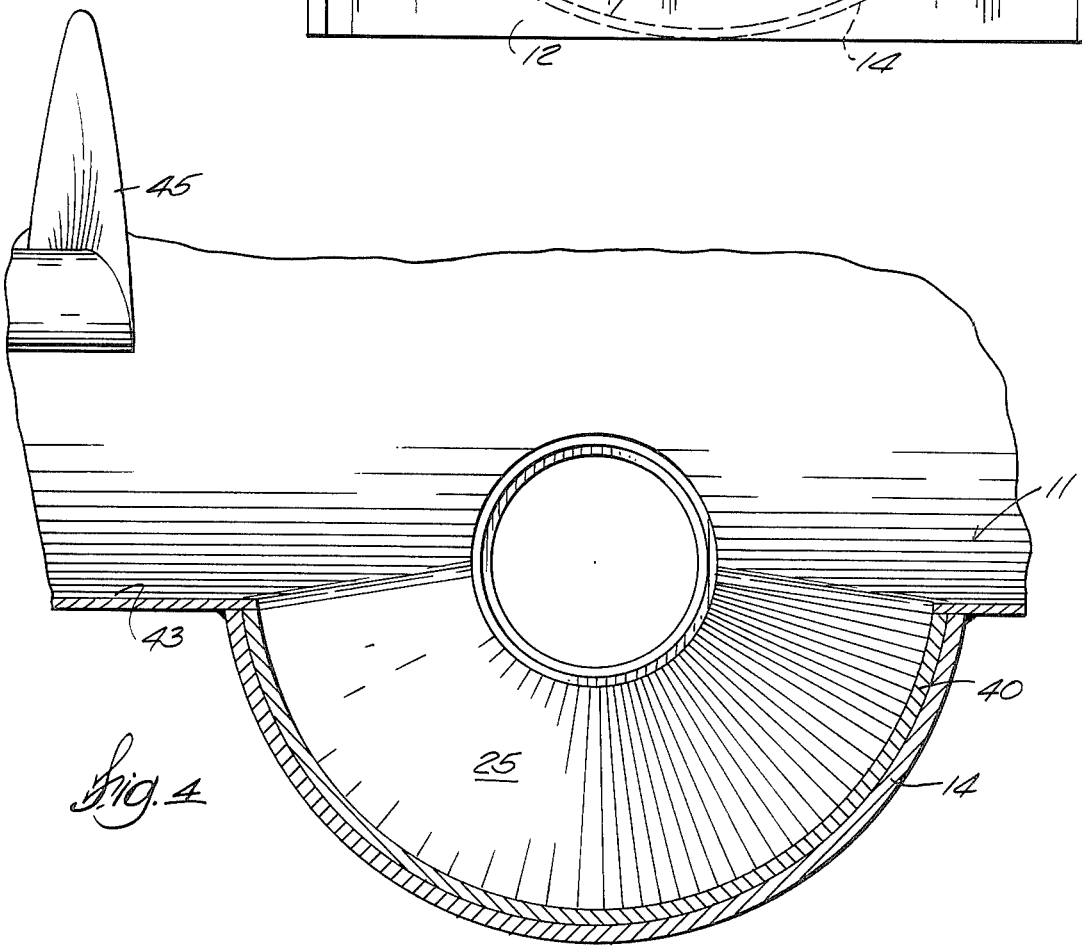
Fig. 4

POSITIVE DISPLACEMENT PUMP FOR SEMI-FLUID MATERIALS

This invention relates to a positive displacement pump for forcing pumpable semi-fluid material, as for instance concrete, into a delivery pipe for transmission to a remote location.

Accordingly, this invention is classifiable with that of the Sherrod U.S. Pat. No. 3,298,322 and in fact it is the purpose and object of the invention to improve the pump of that patent with respect to economy and mobility.

Briefly, the pump of this invention, like that of the Sherrod patent, comprises a pair of pump cylinders having their mouths opening to a feed chamber so that when those mouths are uncovered, material in the feed chamber can be inducted into the pump cylinders by the retraction stroke of their pistons, and a swivel valve located in the feed chamber for oscillation about an axis that is equispaced from the mouths of the pump cylinders, between defined positions in each of which the feed chamber is communicated with one of the pump cylinders by virtue of its mouth being uncovered, while a material conducting passage that extends lengthwise through the swivel valve communicates the other pump cylinder with the delivery pipe.

While the pump of the Sherrod patent is generally quite satisfactory and the embodiment thereof illustrated in FIGS. 9–11 of the patent has been in successful commercial use for a period of time long enough to demonstrate its capability of satisfactorily serving its purpose, that pump is an expensive piece of equipment.

The heart of the pump is its swivel valve by which the mouths of its pump cylinders are alternately communicated with the feed chamber and then with the delivery pipe. Since the inlet end of the material conducting passage through this valve must be spaced from the axis about which the valve swings in order to alternately align with the mouths of the pump cylinders, and its outlet end must be coaxial with the rotation axis to have uninterrupted communication with the delivery pipe, the flow of material being forced through the valve by the discharging pump necessarily undergoes a change in direction. This places a heavy thrust load on the valve in the direction towards its outlet end.

Needless to say, for the pump to be operative that axial force on the swivel valve must be successfully resisted. This, of course, is academic and well understood, but the Sherrod patent did not concern itself with that requirement — in fact, it contains no recognition thereof. From hindsight, it is evident that the omission of any explanation in the patent of how the axial force on the swivel valve was borne resulted from the fact that at the time the various embodiments of the pump that are disclosed in the Sherrod patent were conceived, and that of FIGS. 9–11 developed for commercial use, the patentee and present applicant believed that the only way that thrust load could be carried was by the combination of a heavy thrust and radial bearing or bearings with strong supporting framework therefor. That manner of carrying the thrust load being considered conventional, no disclosure thereof was included in the patent beyond the more or less diagrammatic illustration of the pair of outboard bearings 78 and 80 shown in its FIG. 4 and the bearings 112 shown in FIG. 3.

While the pump illustrated in FIGS. 9–11 of the patent is presently in commercial use and operating satisfactorily, its design does not lend itself to embodiment in a lightweight low cost pump. The cost of the heavy bearing structure employed in that pump to mount the swivel valve and to carry the forces imposed thereon has been an unwelcome disadvantage demanding attention and correction if at all possible.

This invention has achieved that goal. It has accomplished its purpose as a result of the discovery that by giving the bottom surface of the swivel valve a steep cone-shaped profile for substantially its entire axial dimension and similarly shaping the bottom of the feed chamber, the contiguity of those mating surfaces on the valve and on the feed chamber can be utilized to directly transfer to the feed chamber the loads imposed on the valve by the flow of material being forced through its passage by the discharging pump cylinder. With that accomplished, there is no need to consider heavy thrust loads in the design of the bearing or bearings employed to mount the valve. The resulting reduction in cost and weight is significant.

It was also discovered that with the contiguous mating surfaces on the swivel valve and the bottom of the feed chamber shaped to most effectively transmit thrust loads from the valve to the feed chamber, the cross sectional shape of the swivel valve did not have to be like that of the pump now in commercial use, which — as indicated — follows the teachings of the FIGS. 9–11 embodiment of the patent. A much simpler shape serves the purpose.

In fact, it was found that guidance of the material towards the mouths of the pump cylinders was in nowise impaired by reducing the width of the arcuate bottom surface of the valve to a dimension not appreciably greater than the width of the valve at any cross sectional plane. This resulted in a desirably lighter valve.

By virtue of the aforesaid discoveries, this invention provides a greatly simplified and also less costly pump. In addition, the invention makes possible a more compact and more readily portable machine.

With these observations and objectives in mind, the manner in which the invention achieves its purpose will be appreciated from the following description and the accompanying drawings, which exemplify the invention, it being understood that changes may be made in the specific apparatus disclosed herein without departing from the essentials of the invention set forth in the appended claims.

The accompanying drawings illustrate one complete example of the embodiment of the invention constructed according to the best mode so far devised for the practical application of the principles thereof, and in which:

FIG. 3 is a cross sectional view through FIG. 1 on the plane of the line 3—3;

FIG. 4 is a cross sectional view through FIG. 1 on the plane of the line 4—4, but with the swivel valve omitted;

Figures 1, 11:
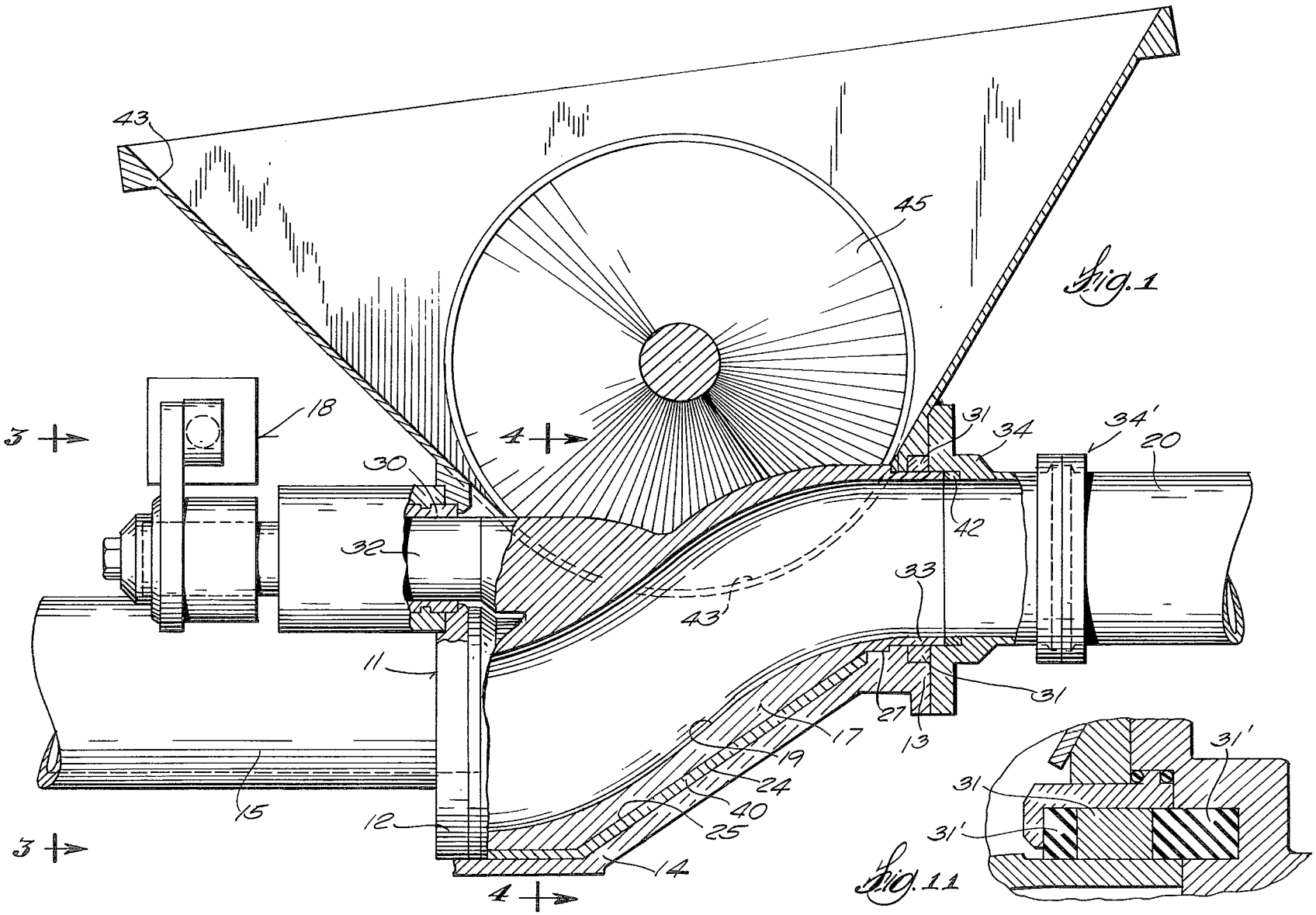
FIG. 1 is a longitudinal sectional view through the pump of this invention, with the swivel valve shown at the mid-point in its range of oscillatory motion.
FIG. 11 (on sheet 1) is a fragmentary sectional view through the junction of the swivel valve with the pipe adapter to which the delivery pipe is connected, illustrating an alternative way of constructing this junction.
Figure 2:
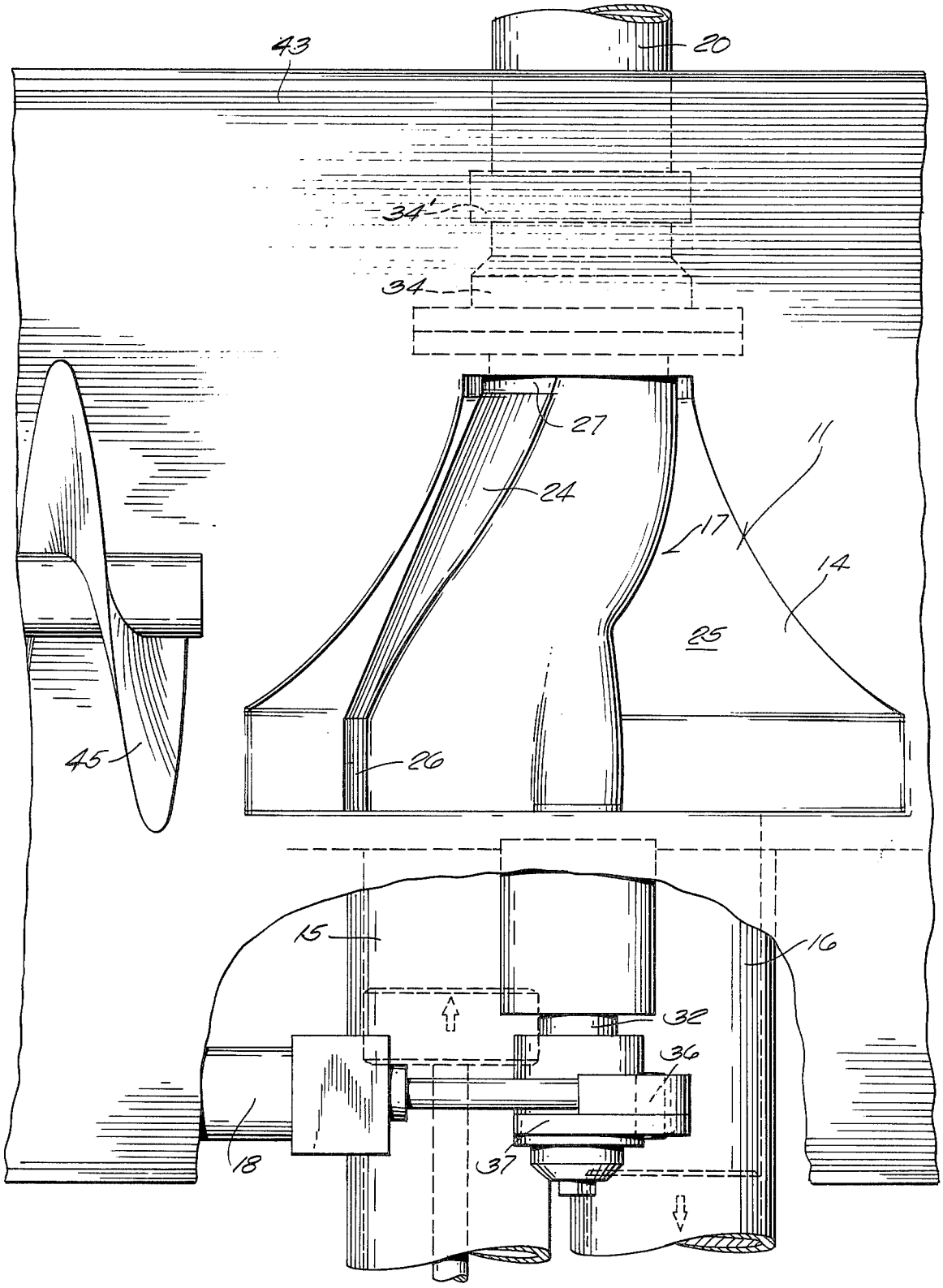
FIG. 2 is a top view of the pump, but in this case showing the swivel valve at one limit of its oscillatory motion.

Referring to the accompanying drawings, the numeral 11 designates the feed chamber of the pump. This chamber is defined by opposite parallel end walls 12 and 13 and a bottom wall 14 that is arcuate in cross section and extends upwardly to provide sides for the feed chamber.

A pair of pump cylinders 15–16 are connected to the end wall 12 with the mouths of the cylinders in open communication with the feed chamber through registering holes in the wall 12.

Mounted within the feed chamber for rotation about a fixed axis equispaced from and parallel to the axes of the pump cylinders — and intersecting the end walls 12 and 13 — is a swivel valve 17. This valve is swung between two defined positions by drive mechanism including a fluid pressure cylinder 18. In each of those positions a material conveying passage 19 that extends lengthwise through the valve communicates the mouth of one of the two pump cylinders with a delivery pipe 20 and uncovers the mouth of the other cylinder so that it has open communication with the feed chamber. Accordingly, upon correctly synchronized swinging of the swivel valve from one position to the other, with timed reciprocation of the pistons in the pump cylinders, material will be inducted into one cylinder by the retraction stroke of its piston, while the expulsion stroke of the piston in the other cylinder forces material into the delivery pipe.

Needless to say, if the material being pumped is to be forced into the delivery pipe in a substantially steady stream, the movement of the swivel valve from one position to the other should be as rapid as possible. It is important, therefore, that the swivel valve be as light as the forces acting on it will permit. The present invention has made the attainment of that objective a possibility.

For the outlet end of the material conveying passage 19 through the valve to be always connected with the delivery pipe, the axis about which the valve swings must be coincident with that of the mouth of the delivery pipe. On the other hand, the inlet end of the passage 19 must be offset from the rotation axis in order for it to align with the mouth of one of the pump cylinders in each operative position of the valve. The resulting S-shaped configuration of the passage 19 effects a change in the the direction of flow through the valve and thereby imposes an axial force of considerable magnitude upon the swivel valve in the direction towards its outlet end. In addition, the offset converts a fraction of this axially directed force into a lateral or radial component that places a radial load on the means holding the valve in alignment with the pumping cylinders and the discharge pipe. The manner in which these forces on the swivel valve are accommodated in the pump of this invention reflects a significant discovery.

Heretofore, as evidenced by the Sherrod patent referred to hereinbefore, it was thought that the forces to which the swivel valve is subjected could only be carried by a heavy combination thrust and radial bearing. The idea of shaping contiguous surfaces on the valve and the feed chamber so that by their contiguity the thrust forces on the valve could be transmitted to and carried by the feed chamber itself, had occurred to no one prior to this invention. With the discovery that this was possible, it was realized that desirable cost and weight reductions could be gained by appropriately shaping the contiguous surfaces of the valve and feed chamber.

In accordance with this discovery the swivel valve has an exterior bottom wall surface 24 which has the shape of a frustum of a cone, the axis of which coincides with the rotation axis of the valve; and the bottom wall of the feed chamber has a correspondingly shaped surface area 25. To be more specific, all portions of these surfaces are uniformly concentric to the rotation axis on every plane normal to the axis and intersecting those surfaces, but with decreasing radii towards the outlet end of the valve; and in all positions of the valve, these surfaces are uniformly contiguous.

Figures 5, 6, 7, 8, 9, 10:
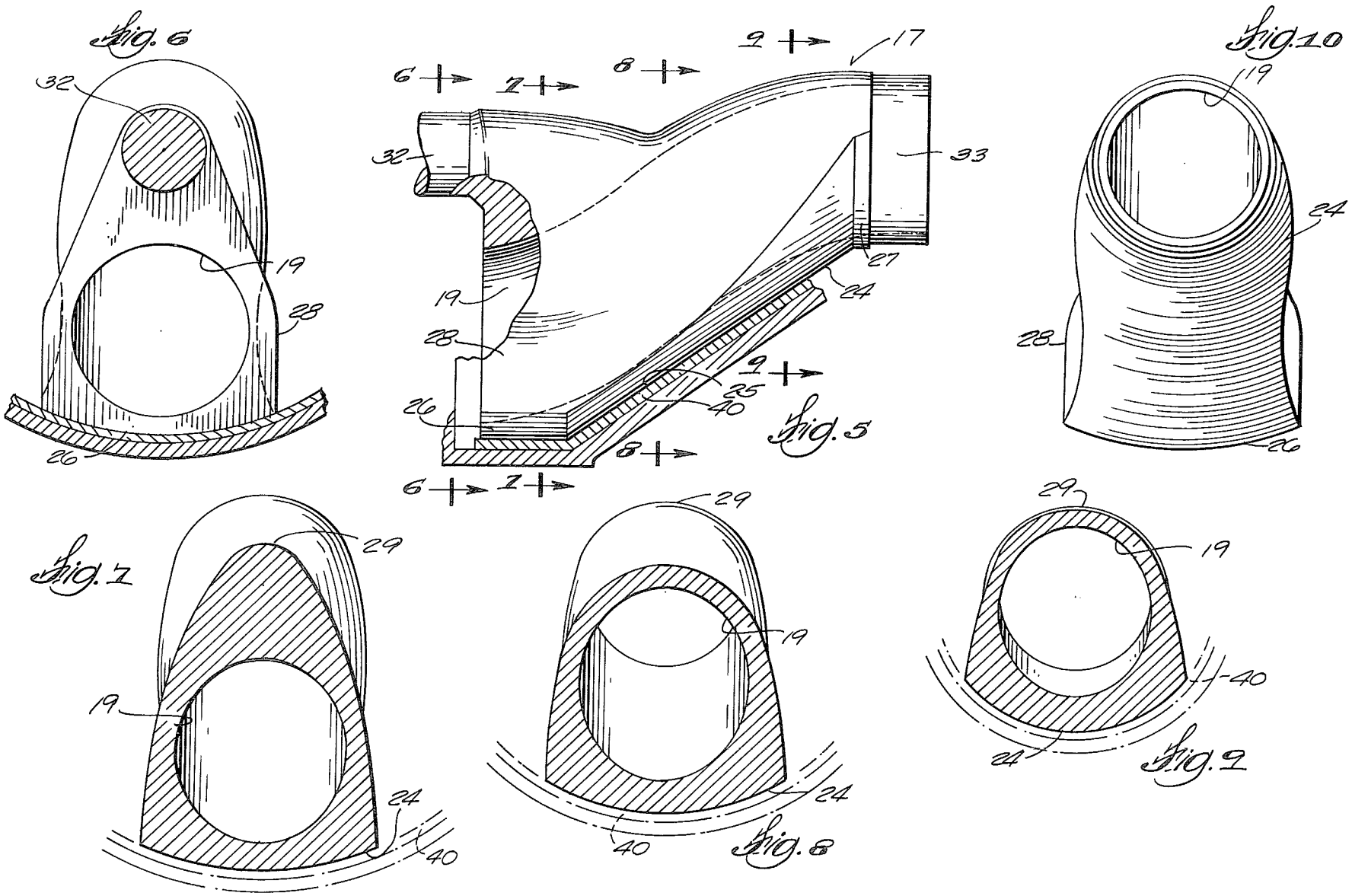
FIG. 5 is a side view of the swivel valve per se, also shown in its mid-position and illustrating in section a portion of the contiguous bottom wall of the feed chamber.
FIG. 6 is a cross sectional view through FIG. 5 on the plane of the line 6—6.
FIG. 7 is a cross sectional view through FIG. 5 on the plane of the line 7—7.
FIG. 8 is a cross sectional view through FIG. 5 on the plane of the line 8—8.
FIG. 9 is a cross sectional view through FIG. 5 on the plane of the line 9—9.
FIG. 10 is an end view of the swivel valve viewing the same from its outlet end.

As seen in FIGS. 3 and 5, the frustoconical surface 24 of the valve, and also the mating surface area 25 of the feed chamber bottom wall, extends for all but a very small part of their axial dimension, and that dimension is substantially the distance between the end walls 12 and 13 of the feed chamber. Only for an axially short distance 26 at its inlet end, and a still shorter distance 27 at its outlet end, is the bottom wall surface of the valve and the mating surface on the feed chamber uniformly spaced from the rotation axis, i.e. cylindrical. Accordingly, for substantially the entire axial length of the valve the mating frustoconical surfaces are effective to transfer the thrust load imposed upon the valve by the discharging pump cylinder as it forces the pumped material through the valve, directly to the bottom wall of the feed chamber which can be suitably reinforced to carry this load.

To enable these forces to be most expeditiously imparted to the bottom wall of the feed chamber, and also to minimize the radial load which they exert upon the bearings by which the swivel valve is mounted in the feed chamber, the angle defined by the mating frustoconical surfaces — with respect to the rotation axis of the valve — is relatively steep, being on the order of 32°. This angle can be identified by comparing the radii of the cylindrical surfaces 26 and 27 at the inlet and outlet ends of the valve with the axial length of the valve, which is substantially the distance between the end walls 12 and 13 of the feed chamber. Thus, as shown in FIGS. 3 and 5, the radius of the surface 26 is approximately five-eighths ($\frac{5}{8}$) of the axial length of the valve, while the radius of the surface 27 is but three-sixteenths (3/16) of the axial length of the valve.

The angle which the mating frustoconical surfaces 24 and 25 form to the rotation axis also bears a definite relationship to the center-to-center offset between the inlet mouth of the valve and its rotation axis. Using this criteria, that angle is correct when the center-to-center offset between the rotation axis and the center of the inlet end of the passage 19 through the valve is between three-eights and one-half ($\frac{3}{8}$ and $\frac{1}{2}$) the end-to-end length of the valve.

While the aforesaid parameters have been found to be very effective in assuring the attainment of the objective of this invention — which is the use of the wall of the feed chamber to carry the load imposed on the swivel valve by the discharging pump cylinder — it should be understood that some deviation therefrom can be tolerated as long as it does not preclude the desired transfer to the wall of the feed chamber of the loads imposed upon the swivel valve.

In the disclosed embodiment of the invention, only simple radial bearings 30 and 31 need be employed at the inlet and outlet ends of the swivel valve to rotatably mount the same. A projecting or attached shaft 32 at the inlet end of the valve is journaled in the bearing 30 and, at the outlet end of the valve, a cylindrical extension 33 projects through a hole in the feed chamber wall 13 and is journaled in the bearing 31.

To couple the outlet end of the valve to the delivery pipe, a pipe adapter 34 is fixed to the end wall 13 of the feed chamber and has the delivery pipe coupled thereto, as at 34'. Attention is directed to the fact that the adapter is substantially a cup-shaped sleeve secured to the feed chamber end wall 13 over the hole through which the end 33 of the valve projects. Accordingly, the joint between the movable valve and the fixed pipe adapter in effect is within the feed chamber and hence requires no seal. The bearing 31 is similarly enclosed by the pipe adapter and the end wall 13.

While, as stated, no seal is required at the junction of the discharge end of the valve and the pipe adapter, it may be desirable to protect the bearing 31 by having it flanked by sealing rings 31' as shown in FIG. 11.

The bearing 30 is fixed with respect to the wall 12 of the feed chamber, which also has the fluid pressure cylinder 18 pivoted thereto, as at 35, to accommodate the arcuate path traced by the connection 36 between the piston rod of the cylinder and an arm 37 fixed to the shaft 32, as the cylinder swings the valve from one position to the other.

While for alignment of the inlet end of the swivel valve with the mouths of the pump cylinders its offset from the rotation axis need not be as great as it is in this invention, it is the steep angle of the mating frustoconical surfaces 24 and 25 that necessitates this rather substantial offset. Admittedly, this increased offset results in greater resistance to the forced flow of material through the valve and concomitantly higher thrust loads on the valve. Ordinarily, this would be regarded as objectionable, but this apparent objection is more than overcome by the reduction in weight of the valve, the simplification of the bearings by which it is mounted in the feed chamber, and the consequent reduction in cost that flows from using the steeply angled mating frustoconical surfaces 24–25 to enable the wall of the feed chamber to effectively support the valve against those forces.

The side surfaces 28 of the swivel valve meet and form with its curved bottom surface 24 an angle — measured between the chord of the curved bottom surface and the side surfaces — that preferably should not be greater than 90° nor less than 65°, and since the length of the chord of the curved surface 24 is not much greater than the transverse dimension of the passage 19, the side surfaces of the valve approach parallelism. The top surface 29 of the valve has a convex curvature that is tangent to its side surfaces. The resulting cross sectional shape of the valve enables its sides to coact most effectively with the bottom wall of the feed chamber in guiding material in the feed chamber towards the uncovered mouth of the charging pump cylinder at each of the two positions of the valve.

Because of the close contiguity of the frustoconical bottom surfaces of the valve and the feed chamber, only the finest particles of the material being pumped can interpose themselves between these surfaces. In the case of concrete, this assures the presence between the surfaces of a thin lubricating film of cement and fine particle paste.

For clarity, FIG. 1 illustrates the swivel valve in its mid-position, i.e. halfway between the opposite limits of its rocking movement during operation of the pump. Also, for the same reason, no attempt has been made in the drawings to illustrate the separability of parts that is needed to enable the swivel valve and feed chamber to be assembled. These are details well understood by anyone skilled in the art.

Those skilled in the art will also understand the desirability of providing a renewable lining 40 for the wall of the feed chamber that is swept by the bottom surface of the swivel valve, as well as a wear plate 41 at the inlet end of the valve and a wear ring 42 between the outlet end of the valve and the adjacent surface of the of the pipe adapter 34.

While the material to be pumped can be introduced into the feed chamber in any desired way, in the pump illustrated a receiving hopper 43 is provided. This hopper extends crosswise of the feed chamber and has an arcuate bottom 44 that is cut out to meet and be joined to the sides of the feed chamber. A screw conveyor 45 in each of the opposite end portions of the hopper moves material dumped into the hopper to the feed chamber.

Those skilled in the art will appreciate that the invention can be embodied in forms other than as herein disclosed for purposes of illustration.

The invention is defined by the following claims:

1. In a positive displacement pump for forcing pumpable material into the receiving end of a delivery pipe, wherein a pump cylinder has a mouth opening to a feed chamber through one of a pair of opposite walls thereof, so that pumpable material in the feed chamber can be inducted into the cylinder during the retraction stroke of its piston, wherein a hole in the other one of said walls of the feed chamber opens to the receiving end of the delivery pipe, wherein a tubular swivel valve is mounted in the feed chamber between its said opposite walls for oscillation about a fixed axis that is coaxial with the receiving end of the delivery pipe and offset from the axis of the mouth of the pump cylinder, between pump charging and discharging positions wherein said swivel valve has a substantially S-curved material conveying passage extending lengthwise therethrough with its outlet end coaxial with the rotation axis of the valve and at all times in communication with the receiving end of the delivery pipe, and its inlet end offset from said rotation axis to register with and receive material expelled from the mouth of the pump cylinder upon oscillation of the swivel valve in timed relation with the reciprocation of the pump piston, the improvement which resides in:

A. all of that portion of said material conveying passage which is curved along the length thereof being between said opposite walls of the feed chamber;

B. the distance between said opposite walls of the feed chamber being such that a substantial area of the surface of said passage extends obliquely across the path of material being discharged from the pump cylinder at an angle to said path so steep as to cause such material to impose a substantially high axial thrust force upon the valve;

C. said swivel valve having an exterior surface for transmitting said axial thrust force upon the valve, which surface (1) lies directly radially outward of said area with respect to the rotation axis of the valve, (2) lies entirely within the feed chamber and substantially spans the distance between said opposite walls thereof, (3) has its axially opposite ends offset from one another substantially the same distance as are the axially opposite ends of the material conveying passage, (4) for its entire axial dimension is transversely arcuate, and (5) on every plane normal to the rotation axis of the valve and intersecting said exterior load transmitting surface is uniformly concentric to said rotation axis, but with decreasing radii towards the outlet end of the swivel valve so that for its entire axial dimension said load transmitting surface is substantially part of a cone; and D. the feed chamber having another wall with an inner surface shaped to conform to the sweep of said arcuate exterior load transmitting surface of the swivel valve as the swivel valve oscillates about its rotation axis and in every position of the swivel valve has an area thereof uniformly contiguous to every part of said arcuate load transmitting surface of the swivel valve, so that said wall of the feed chamber receives and bears the axial thrust imposed upon the swivel valve by the material being discharged from the pump cylinder.

2. The improvement defined by claim 1, wherein the largest of said radii is approximately five-eighths of the axial length of the valve and the smallest of said radii is approximately three-sixteenths of the axial length of the valve.

3. The improvement defined by claim 2, wherein each of said contiguous wall surfaces forms a segment of a frustum of a cone.

4. The improvement defined by claim 3, wherein said arcuate wall surface of the swivel valve has a substantially uniform width along the length thereof.

5. The improvement defined by claim 1, wherein said arcuate wall surface on the swivel valve is the bottom thereof, and said contiguous feed chamber wall surface is the bottom of the feed chamber.

6. The improvement defined by clain 5, wherein the swivel valve has substantially flat opposite exterior side surfaces that meet its said arcuate bottom wall surface and coact with the bottom of the feed chamber to guide material toward the mouths of the pump cylinders.

7. The improvement defined by claim 6, wherein the corner formed by the junction of each of said side surfaces with said arcuate bottom surface of the swivel valve defines an angle that, measured between the chord of the arcuate bottom surface and the side surfaces, is no more than 90° and no less than 65°.

8. The improvement defined by claim 7, wherein said exterior side surfaces of the swivel valve approach parallelism.

9. The improvement defined by claim 8, wherein in cross section the exterior top wall of the swivel valve is convex and tangent to the side surfaces of the valve.

10. The improvement defined by claim 1, wherein each of said contiguous wall surfaces forms a segment of a frustum of a cone.

11. The improvement defined by claim 1, wherein said arcuate wall surface of the swivel valve has a substantially uniform width along the length thereof.

12. The improvement defined by claim 1, wherein the tubular swivel valve is mounted by bearing means comprising a shaft fixed with respect to the valve and projecting from its inlet end through a hole in the adjacent wall of the feed chamber; and a radial bearing fixed with respect to the feed chamber and the pump cylinder and having said shaft journaled therein.

13. The improvement defined by claim 12, wherein the outlet end of the swivel valve terminates in a cylindrical portion coaxial with said shaft; wherein said bearing means further comprises a radial bearing fixed with respect to the feed chamber and having said cylindrical portion journaled therein; and means forming a swivel connection between said cylindrical portion and the delivery pipe.

14. The improvement defined by claim 13, further characterized by wall means defining a supply hopper to receive material to be pumped, the supply hopper and the feed chamber being joined to one another with the latter beneath the former and communicating therewith so that material deposited in the supply hopper can be fed to the feed chamber; and a conveyor screw in the supply hopper to move material therein towards its communication with the feed chamber, the axis of the conveyor screw being transverse to and intersecting a vertical plane containing the axis of rotation of the swivel valve.

15. The improvement defined by claim 14, wherein the feed chamber has opposite side walls and opposite end walls, the top edges of said side and end walls defining the entrance into the feed chamber, said end walls being contiguous to the opposite ends of the swivel valve; and further characterized in that the supply hopper has a hole in its bottom conforming in size and shape to the top edges of the side and end walls of the feed chamber; and means joining the top edges of said feed chamber walls to the bottom of the supply hopper.

16. The improvement defined by claim 14, further characterized in that the upper portion of the swivel valve projects through said hole in the bottom of the supply hopper.

17. The improvement defined by claim 1, further characterized by a sleeve providing a pipe adapter secured to said other one of said walls of the feed chamber over the hole therein, the discharge pipe being coupled to the pipe adapter and forming a continuation thereof, and the securement of said sleeve to said wall of the feed chamber resulting in the interior of the pipe adapter and the feed chamber interior together forming a common enclosure, and wherein the outlet end of the swivel valve is in said common enclosure.

* * * * *